US009320376B2

(12) United States Patent
Ivankovic et al.

(10) Patent No.: US 9,320,376 B2
(45) Date of Patent: Apr. 26, 2016

(54) REUSABLE FOOD COVERS

(71) Applicant: Food Huggers Inc., Dover, DE (US)

(72) Inventors: Michelle Ivankovic, Amsterdam (NL); Adrienne McNicholas, Madrid (ES)

(73) Assignee: Food Huggers Inc., Dover, DE (US)

( * ) Notice: Subject to any disclaimer, the term of this patent is extended or adjusted under 35 U.S.C. 154(b) by 91 days.

(21) Appl. No.: 13/954,475

(22) Filed: Jul. 30, 2013

(65) Prior Publication Data

US 2014/0238887 A1 Aug. 28, 2014

Related U.S. Application Data

(60) Provisional application No. 61/769,312, filed on Feb. 26, 2013, provisional application No. 61/838,461, filed on Jun. 24, 2013.

(51) Int. Cl.

| | |
|---|---|
| ***B65D 41/01*** | (2006.01) |
| ***B65D 43/03*** | (2006.01) |
| ***A47G 19/26*** | (2006.01) |

(52) U.S. Cl.

CPC ..... *A47G 19/265* (2013.01)

(58) Field of Classification Search

CPC ..... A23B 7/00; B65D 85/34; B65D 81/03; B65D 37/00; B65D 2543/00537; B65D 77/0486; B65B 53/00; F16L 55/115

USPC ..... 206/521.1, 521.2, 521.6, 521.8, 514, 206/562, 563; 220/305, 505, 506, 380, 287, 220/790, 799, 802; 426/410, 132, 115, 112; 215/319; 99/645

See application file for complete search history.

(56) References Cited

U.S. PATENT DOCUMENTS

| | | | | |
|---|---|---|---|---|
| 5,749,491 | A | 5/1998 | Wylder et al. | |
| 2004/0191369 | A1 * | 9/2004 | Veillon | 426/106 |
| 2006/0070907 | A1 * | 4/2006 | O'Shea | 206/514 |
| 2006/0169693 | A1 | 8/2006 | Yeung | |
| 2008/0073366 | A1 | 3/2008 | Backaert | |
| 2009/0166239 | A1 * | 7/2009 | Seehoff et al. | 206/524.1 |

FOREIGN PATENT DOCUMENTS

| | | | | |
|---|---|---|---|---|
| FR | 2903163 | A1 * | 1/2008 | B65D 43/0222 |
| JP | 2013100130 | A * | 5/2013 | B65D 1/26 |
| WO | WO2012018586 | A2 * | 2/2012 | |

OTHER PUBLICATIONS

FR_2903163_translation.*
JP_2013100130_translation.*
Written Opinion dated Feb. 26, 2013 for Application No. PCT/US2014/017303.
Foodhuggers, Food Huggers Video, <https://www.youtube.com/watch?v=Cck6n-ZkhCk> available at least as early as Feb. 21, 2014.

* cited by examiner

*Primary Examiner* — Mickey Yu
*Assistant Examiner* — Allan Stevens
(74) *Attorney, Agent, or Firm* — Plumsea Law Group, LLC

(57) ABSTRACT

The present disclosure is directed to reusable food covers. Such reusable food covers may be flexible so that they can create a seal with partially consumed foods, such as fruits and vegetables, to preserve these foods and extend the time of being suitable and desirable for consumption. Each cover may include a base and a flexible wall formed as a single unitary structure.

27 Claims, 22 Drawing Sheets

REUSABLE FOOD COVERS

CROSS-REFERENCE TO RELATED APPLICATIONS

This application claims priority to U.S. Provisional Application No. 61/838,461, filed Jun. 24, 2013 and to U.S. Provisional Application No. 61/769,312, filed Feb. 26, 2013, both of which are expressly incorporated herein by reference.

FIELD OF THE DISCLOSURE

The present disclosure is directed to a reusable food cover. More particularly, the present disclosure is directed to a reusable food cover or a set of reusable food covers that can be applied to preserve foods, such as fruits and vegetables, which have been cut or partially consumed.

BACKGROUND OF THE DISCLOSURE

Food covers for storing partially used fruits and vegetables are widely available in an assortment of configurations. Some of these food covers are rigid containers for storing fruits and vegetables, such as onions, tomatoes, and bananas. These food covers typically include two separate, rigid pieces. These pieces can both be dish-like or one piece can be dish-like and the other flat. These pieces are joined by a threaded connection that requires mating the threads and screwing the pieces together to enclose the food therein. Mating the threads can require care and patience.

Alternatively, these rigid containers can be formed of a single piece of material that includes two rigid dish-like halves joined by a hinge.

These types of rigid cases leave food exposed to significant open air circulation and fail to offer an adequate seal over the exposed sections of fruit or vegetables. These rigid containers may also typically designed and shaped to resemble the particular foods they contain, and thus may fail to offer the flexibility of being able to adequately preserve a wide variety of foods of various shapes.

Some of these containers are opaque so that the food is difficult to identify. Some of these containers have a transparent half and an opaque half. Although the food is visible through the transparent half, and opaque half may obscure the food from view. In both cases, a user may need to open or flip the container to see the contents. In the first case, this exposes the food to more air. In both cases, a user may overlook such enclosed food until it is unusable.

Additionally, these containers are bulky, since they are larger than the food enclosed within and thus may take up the limited space in a user's fruit and vegetable drawers in a refrigerator. The two-piece versions of these containers require a user to locate both pieces in order to use the containers, which can be an added hurdle to use.

Another way to preserve food is using plastic wraps, which are available in a variety of configurations. Plastic wraps are typically sold in rolls or sheets and can be applied to partially consumed fruits and vegetables to preserve their freshness. Since plastic wraps are not sufficiently durable to be used on multiple occasions, washed, nor reapplied suitably over and over again, they are typically used one time and thrown away. This is wasteful. Plastic wraps also fail to provide a strong connection with the food being preserved. In order to hold and/or seal the plastic wrap on the food, an additional member, such as a rubber band must be used.

Thus, a need exists for a food cover that allows for an adequate seal on partially consumed foods. A need also exists for food covers that are durable enough to be reusable and capable of being used across a wide variety of food items.

BRIEF SUMMARY OF THE DISCLOSURE

The present disclosure relates to reusable food covers. Moreover, the disclosed covers are one-piece dish-shaped covers capable of self-securing to food to decrease air flow and preserve partially consumed food longer. The covers are of a size and scale that is suitable to cover most foods, such as fruits and vegetables. These covers are a convenient tool to help users reduce the waste of partially consumed foods, which become no longer edible nor desirable, due to their exposure to air, loss of moisture, or the loss of the natural preservation properties of their skins. Without the application of the reusable food covers, the food would be exposed to bacteria, dehydrate and rapidly cease to be appealing for consumption.

The disclosed covers may be shaped to resemble circular foods, such as tomatoes, or shaped to resemble foods such as avocados. Moreover, the covers may include a thin section or live hinge and hemispherical section for use with pitted foods, such as avocados. The disclosed covers may also be configured and dimensioned to create a set that may allow the food covers to nest within one another.

BRIEF DESCRIPTION OF THE DRAWINGS

In the accompanying drawings that form a part of the specification and are to be read in conjunction therewith, illustrate by way of example and not limitation, with like reference numerals referring to like elements, wherein:

FIGS. 49 and 50 are end and side views respectively of the large cover of FIG. 47;

DETAILED DESCRIPTION

Figure 1:
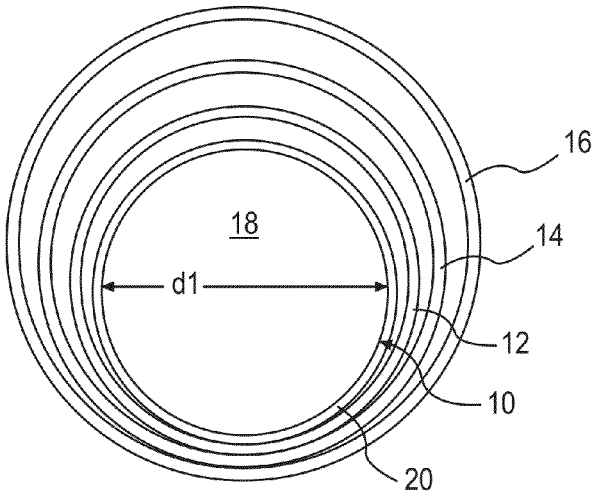
FIG. 1 is a perspective view of a set of four nested reusable food covers of a first exemplary configuration.
Figure 2:
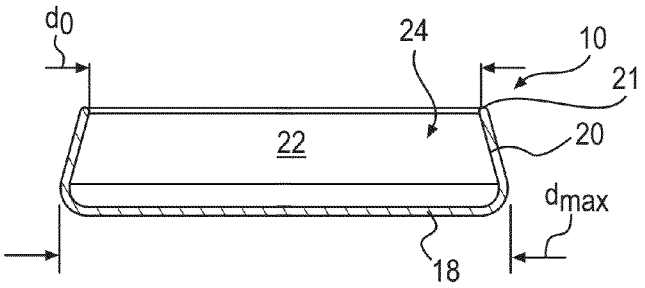
FIG. 2 is a cross-sectional view of one of the first exemplary food covers of FIG. 1 in an unstretched or initial state.

Referring to FIG. 1, a set of four nested reusable food covers 10, 12, 14, 16 of a first exemplary configuration are shown. Small food cover 10 fits within medium food cover 12, which fits within large food cover 14, which fits within extra-large food cover 16. Referring to FIGS. 1 and 2, small food cover 10 includes flat flexible base 18 and flexible wall 20 extending upwardly from and surrounding base 18 to define chamber 22 and opening 24. Base 18 and flexible wall 20 may be generally circular in shape. In FIGS. 1 and 2, covers 10, 12, 14 and 16 are shown in an unstretched or initial state where cover 10 has not been installed on food 26, which may be a lime (shown in FIG. 3).

Referring to FIG. 2, cover 10 has maximum diameter $d_{max}$ that may be greater than opening diameter $d_o$. The maximum diameter $d_{max}$ may be at the bottom of cover 10. As a result, the diameter of cover 10 may taper inwardly from base 18 to free end 21 of wall 20. Furthermore in use, (see FIGS. 2-3) food 26 (such as lime) with food diameter $d_f$ upon installation that may be adjacent free end 21 of wall 20. Food diameter $d_f$ may be greater than opening diameter $d_o$. As a result, when food 26 is inserted within chamber 22, wall 20 moves outwardly and compresses food 26. This compression may reduce air flow into chamber 22; however it may not eliminate air flow.

Figure 3:
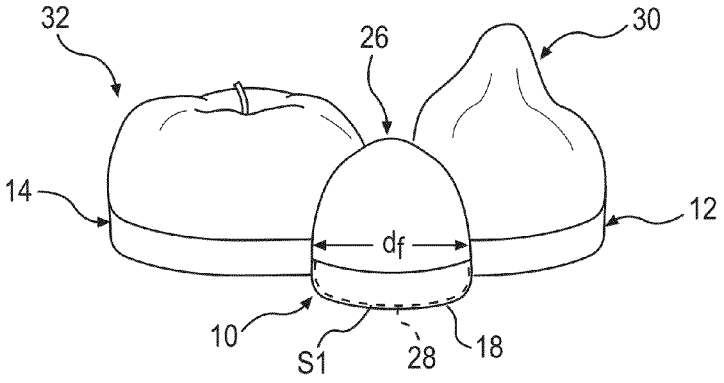
FIG. 3 is a perspective view of three of the first exemplary food covers of FIG. 1 in a final or stretched state with food therein.

Once a user partially consumes food, such as fruits or vegetables by cutting, peeling or eating the food, the natural skin is removed. With reference to FIGS. 2-3, to use cover 10, a user stretches the flexible wall 20 into an intermediate state where opening 24 may be enlarged greater than diameter $d_o$ and $d_f$. Then, user puts cover 10 on exposed surface 28 of food 26 so that exposed surface 28 contacts base 18 and forms first seal S1 therewith. First seal S1 prevents air circulation to exposed surface 28 of food 26 and acts as an artificial skin to help extend the period of freshness by limiting exposure to air, loss of moisture or loss of the natural preservation properties of the skin. Once the user releases the wall 20 of cover 10, cover 10 is in a stretched or final state where opening $d_o$ may be greater than $d_f$.

Cover 10 can be easily removed when additional consumption of the food may be desired and can be replaced again if there remains a further need to preserve the freshness of the remaining food. The ease of use of cover 10 enables users to consume food 26 in a fresh state multiple times without experiencing the quick and significant loss of freshness, which would happen if left unsealed and exposed to open air.

The resilient nature of the material forming cover 10 as well as opening diameter $d_o$ (see FIG. 1) in the unstretched state being smaller than food diameter $d_f$ (see FIG. 3) allows cover 10 to exert a compressive force on food 26 and securely connects cover 10 with food and allows cover 10 to remain thereon until it is removed.

Covers 10, 12, 14 and 16 may be integrally formed of a single, unitary material using process such as for example molding. Covers 10, 12, 14 and 16 may be formed of a flexible material such as silicone or high grade food safe silicone. Referring to FIG. 1, covers 10, 12, 14 and 16 may be formed of a material of a single color or each size cover may be formed of a different color material so that the sizes are color coded. This will allow users to quickly identify the different sizes of covers 10, 12, 14 and 16.

In FIG. 3, covers 10, 12, and 14 are shown on one or more types of food (shown here as a lime) 26, as well as a lemon 30 and tomato 32, respectively. Covers 10, 12, 14 and 16, however, can be used on a variety of foods such as fruits and vegetables exemplified by apples, onions and peppers. Since covers 10, 12, and 14 are in a variety of sizes and depths, they can be used with a variety of foods. Furthermore, the sizes and depths of covers 10, 12, and 14 are exemplary and they may be modified to accommodate other foods.

Figure 4:
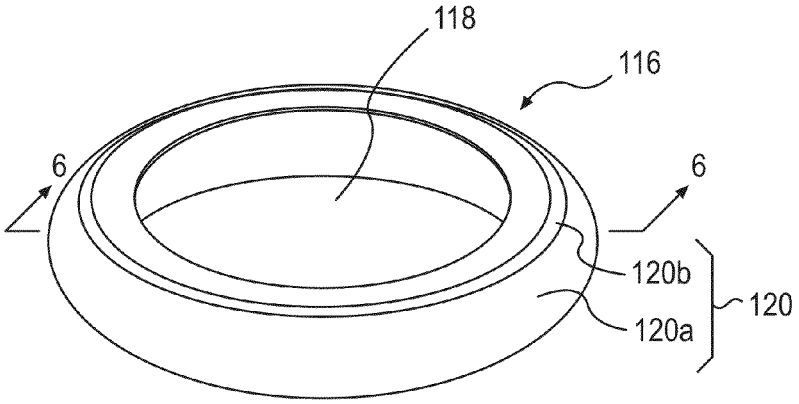
FIG. 4 is a perspective view of an extra-large second exemplary food cover in an unstretched state.
Figure 5:
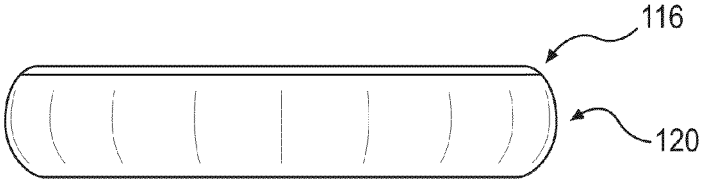
FIG. 5 is a side view of the food cover of FIG. 4.
Figure 6:
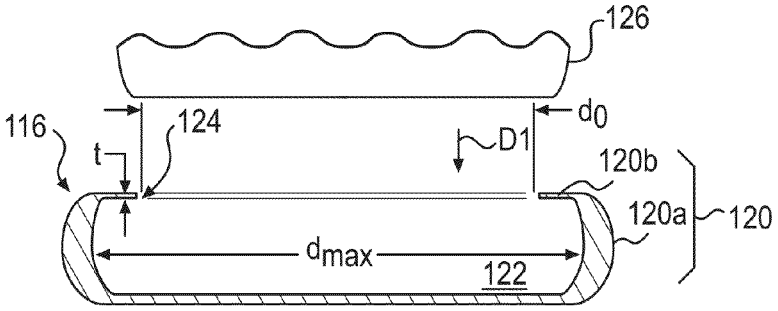
FIG. 6 is a cross-sectional view of the food cover of FIG. 4 along arrow 6-6 of FIG. 4, where the cover is an unstretched state.

Referring to FIGS. 4-5, second exemplary extra-large cover 116 is shown. Cover 116 is similar to cover 16 of FIG. 1 except flexible wall 120 includes first section **120*a* extending upwardly from and surrounding base 118 and second section 120*b* extending radially inwardly from first section 120*a*. Referring to FIG. 6, second section 120*b* has thickness t that allows second section 120*b* to move as described below. Cover 116 also defines chamber 122 and opening 124 similar to cover 16**.

Chamber 122 has maximum diameter $d_{max}$ that may be greater than opening diameter $d_o$. This allows cover 116 to accommodate foods having a range of differing sizes from $d_{max}$ to $d_o$. Furthermore in use, food 126 (such as tomato shown) had food diameter $d_f$ upon installation that may be adjacent wall second section 120*b*. Food diameter $d_f$ may be greater than opening diameter $d_o$.

Figure 7:
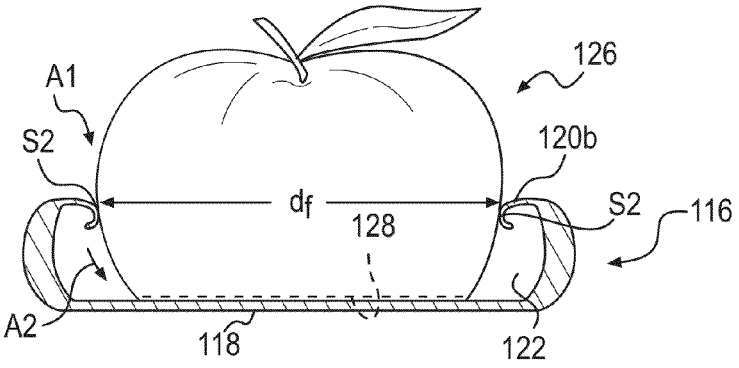
FIG. 7 is a cross-sectional view of the food cover of FIG. 6 where the cover is in a final state with food therein.

Once a user partially consumes food such as fruits or vegetables by cutting, peeling or eating the food, the natural skin is removed. With respect to FIGS. 6 and 7, to use cover 116, a user pushes food 26 in downward direction D1 toward and into chamber 122. Food 126 causes second section 120*b* of flexible wall 120 to compress or move or curl downward. As a result, second seal S2 is formed between food 126 and cover 116. In this final state, wall section 120*b* compressed food 126 to provide a tight fit on food so that cover self-adheres/self-secures to food and reduces air flow by creating seal S2. Second seal S2 extends around the perimeter of food 126 to help prevent air A1 from entering chamber 122.

When exposed surface 128 of food 126 contacts base 118, first seal S1 may be formed there between. First seal S1 may prevent air A2 from contacting exposed surface 128. Thus, cover 116 acts as an artificial skin to help extend the period of freshness as discussed above. Cover 116 can be easily removed by pulling food 126 out of cover 116 in the direction opposite direction D1. Thus, food 126 may be easily removed from cover 116 and replaced multiple times like cover 10.

Figure 8:
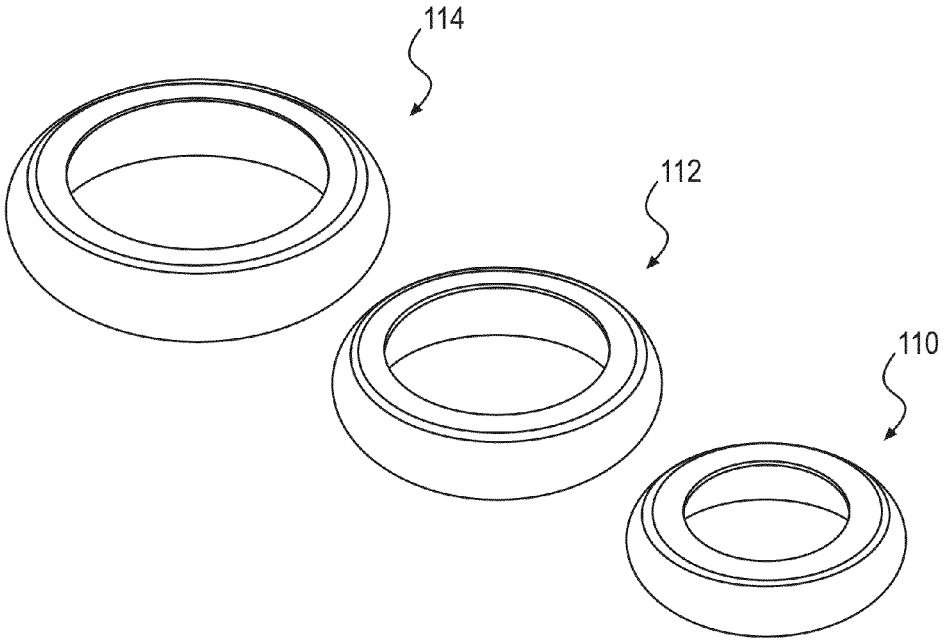
FIG. 8 is a perspective view of three additional sizes of the second exemplary food covers in an unstretched state.
Figure 9:
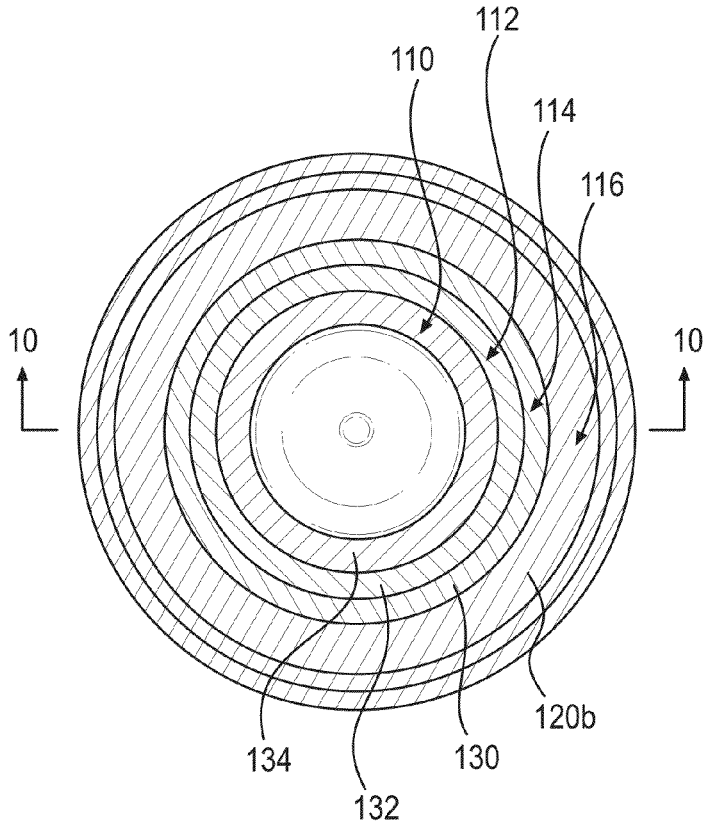
FIG. 9 is a top view the food covers of FIGS. 4 and 8 nested.
Figure 10:
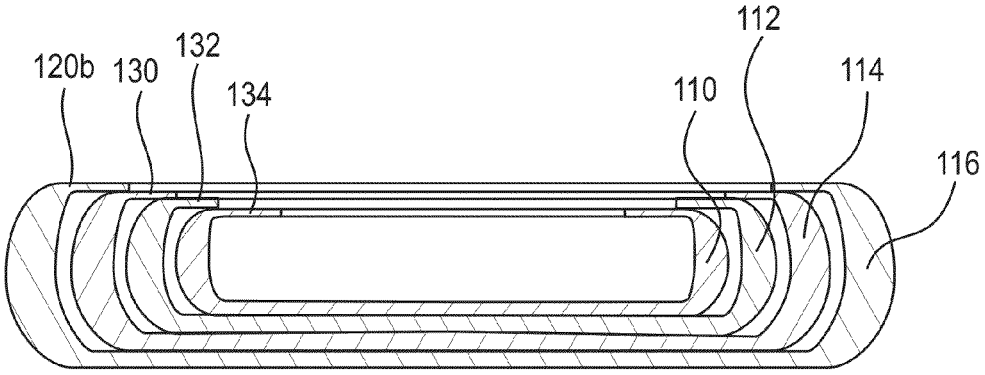
FIG. 10 is a cross-sectional view of the nested food covers of FIG. 9 along arrow 10-10 of FIG. 9.

Referring to FIG. 8, additional covers 110, 112, and 114 are shown. Small cover 110, medium cover 112 and large cover 114 may form a set with extra-large cover 116 (See FIG. 4). As shown in FIGS. 9-10, covers 110, 112, and 114 may be configured and dimensioned so that covers 110, 112, and 114 can be nested. Wall second section 120*b* of cover 116 and cover 114 are configured and dimensioned to so that wall second section 120*b* retains cover 114 therein. Wall second section 130 of cover 114 and cover 112 are configured and dimensioned to so that wall second section 130 retains cover 112 therein. Wall second section 132 of cover 112 and cover 110 are configured and dimensioned to so that wall second section 132 retains cover 110 therein. As shown in FIG. 10, cover 110 also includes a wall second section 134, which can be disposed adjacent to wall second section 132 of cover 112 when cover 110 is retained by cover 112.

Figure 11:
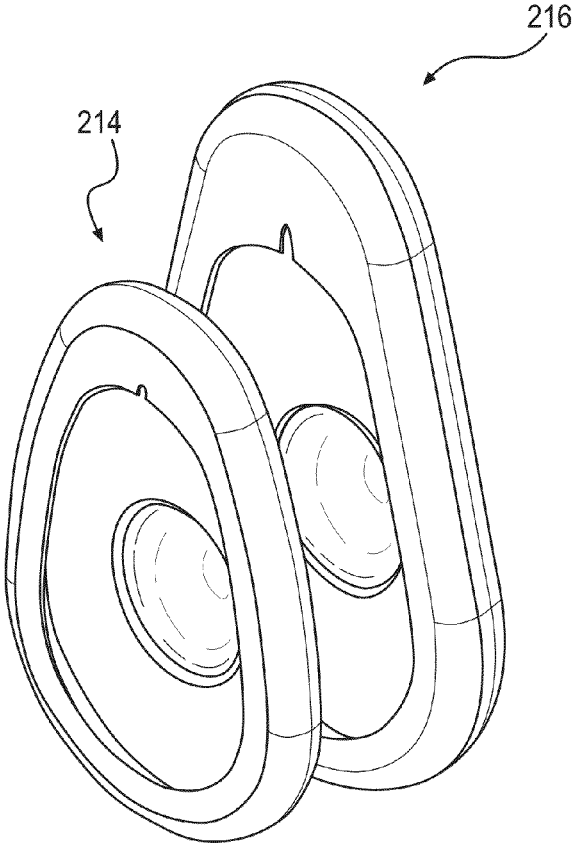
FIG. 11 is a perspective view of two sizes of third exemplary food covers, where the covers are in an unstretched state.

Referring to FIG. 11, third exemplary covers 214 and 216 are shown. Small cover 214 and large cover 216 are similar to cover 116 previously discussed, except covers 214, 216 are configured and dimensioned for use with pitted foods, such as avocados.

Figure 12:
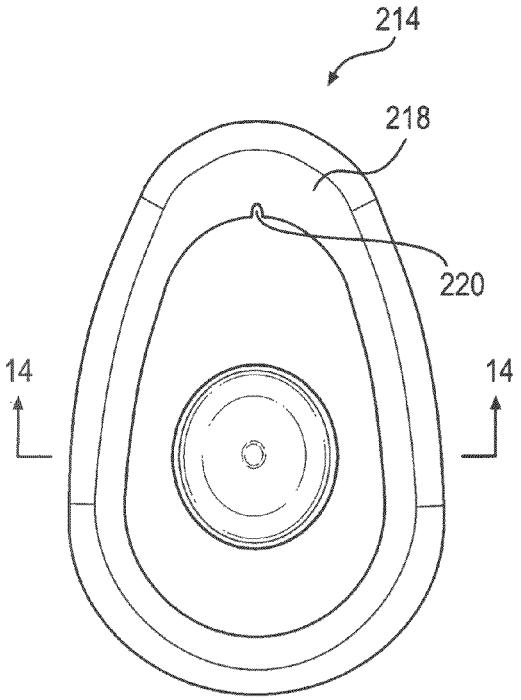
FIG. 12 is a front view of the small food cover of FIG. 11, where a pit chamber is in a concave state.
Figure 13:
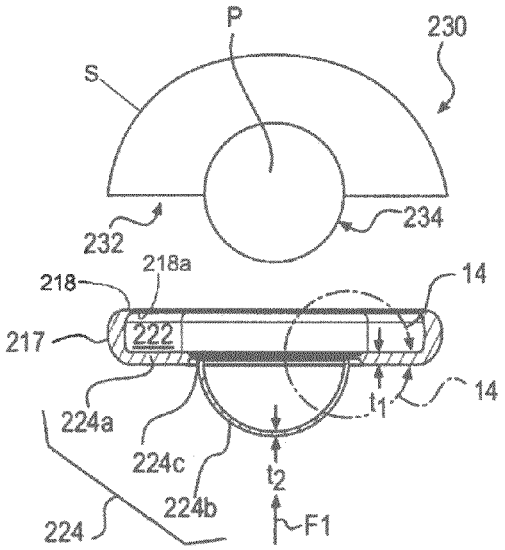
FIG. 13 is a cross-sectional view along arrow 13-13 of FIG. 12 of the food cover of FIG. 12.
Figure 14:
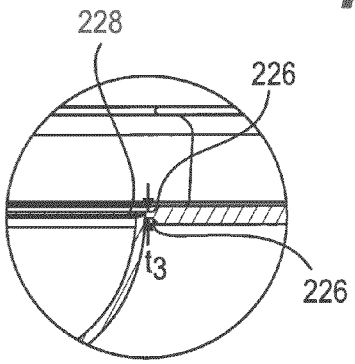
FIG. 14 is an enlarged view of the portion of the cover of FIG. 13 within circle 14-14.

Referring to FIGS. 12-14, small cover 214 will be discussed. In order to accommodate pitted food, cover 214 includes wall second section 218 with optional slit 220. Slit 220 allows wall second section 218 to bend inwardly when food (not shown) is inserted therein similar to cover 116 (see FIG. 7). Similar to cover 16 small cover 214 also defines first chamber 222. Base 224 includes base first section 224*a*, base second section 224*b* and base third section 224*c* there between. Base 224 and flexible wall 217, including wall second section 218, may be generally shaped to resemble a halved avocado. Base second section 224*b* may be molded into a hemispherical shape similar to the shape of a half of an avocado pit.

Base first section 224*a* has first thickness $t_1$ greater than second thickness of $t_2$ of base second section 224*b*. Base third section 224*c* includes angled wall sections 226 and neck wall section 228. Third thickness $t_3$ of neck wall section 228 may be less than second thickness $t_2$ making neck wall section 228 the thinnest section of base 224. Referring to FIG. 5, third thickness $t_3$ allows base second section 224*b* to move as described below.

During use cover 214 functions similarly to cover 116 (shown in FIG. 7), except as discussed below. If a user inserts food 230, such as an avocado, into cover 214, wall second section 218 compresses and allows the food 230 to be disposed within chamber 222. Food 230 has skin S and when food 230 is within chamber 222, inner surface 218*a* of wall second section 218 contacts skin S to hold food 230 in place. Food 230, additionally has exposed fruit surface 232 and exposed curved surface 234. When food 230 contacts base 224, first seal may be formed between exposed flat surfaces 232 and base section 224*a*. In addition first seal may be formed between exposed curved surface 234 and base second section 224*b*. When food 230 has a pit P, base second section 224*b* may be concave, as shown in FIGS. 12 and 13, to mate with convex exposed curved surface 234.

Figure 15:
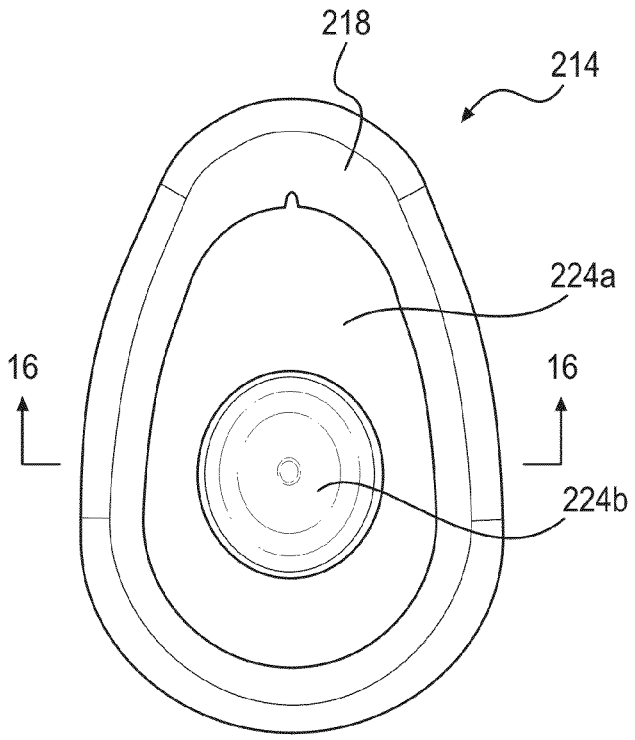
FIG. 15 is a front view of the food cover of FIG. 12, where the pit chamber is in a convex state.
Figure 16:
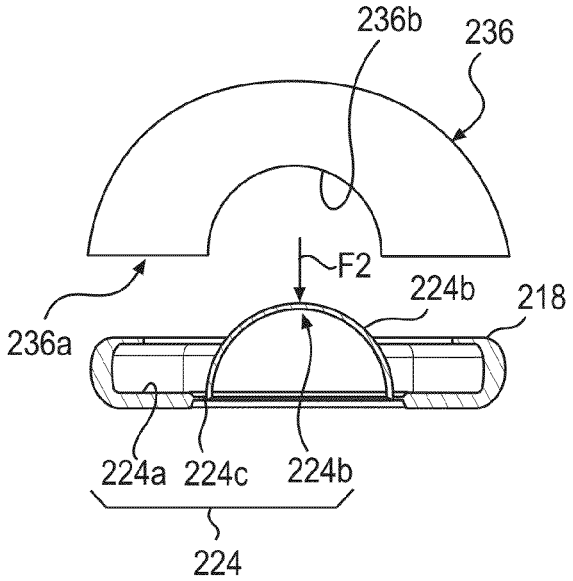
FIG. 16 is a cross-sectional view along arrow 16-16 of FIG. 15 of the food cover of FIG. 15.

Referring to FIGS. 15 and 16, if a user inserts food 236, such as an avocado without pit P (shown in FIG. 13), into cover 214, wall second wall section 218 bends as previously discussed above to form second seal with food 236. Since food 236 lacks pit P (See FIG. 13), food 236 has flat exposed surface 236*a* and concave exposed surface 236*b*. When food 236 contacts base 224, first seal (not shown) will be formed between flat exposed surfaces 236*a* and base first section 224*a*. A user applies force F1 on the base second section 224*b* to move base second section 224*b* from a concave state (shown in FIG. 13) to convex state (shown in FIG. 16). As a result, first seal may also be formed between concave exposed surface 236*b* and base second section 224*b*. When food 236 lacks a pit, base second section 224*b* may be convex, as shown in FIGS. 15 and 16, to mate with concave exposed surface 236*b*. In order to move base second section 224*b* back into its convex state for use with a pitted food, a user would apply force F2 to base second section 224*b*. This action may be due to hinge mechanism of base third section 224*c*. Cover 214 including hinge or third base section 224*c* may be formed of the same material.

Figure 17:
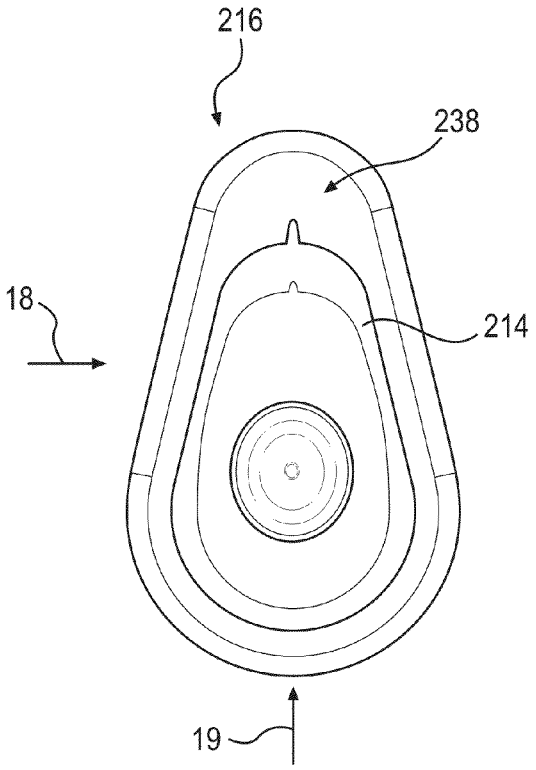
FIG. 17 is a front view of the large food cover of FIG. 11.
Figure 18:
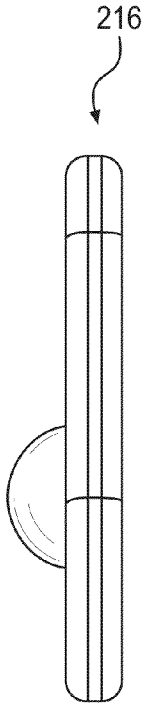
FIG. 18 is a side view along arrow 18 of FIG. 17 of the food cover of FIG. 17.
Figure 19:
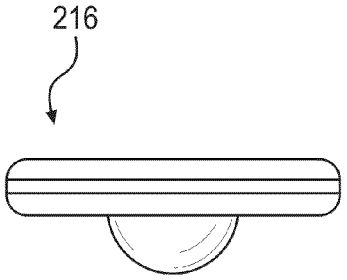
FIG. 19 is an end view along arrow 19 of FIG. 17 of the food cover of FIG. 17.

Referring to FIGS. 11 and 17-19, large cover 216 may be formed similar to small cover 214 and thus operates similarly, except the dimensions of large cover 216 are greater than small cover 214 to accommodate larger food. In FIG. 17, small cover 214 may be nested within large cover 216 and wall section 238 of large cover 216 may be configured and dimensioned to retain small cover therein.

Figure 20:
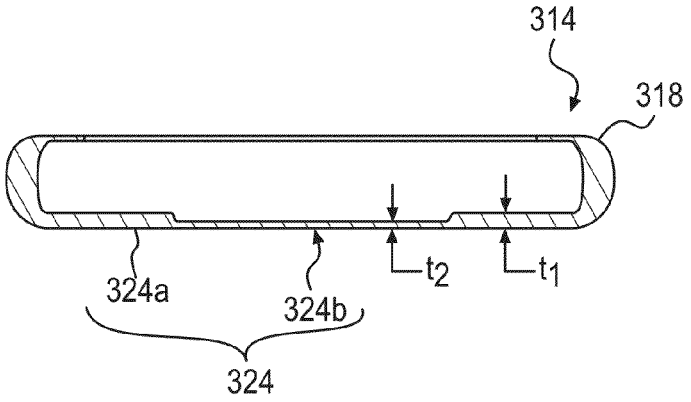
FIG. 20 is a cross-sectional view of a fourth exemplary food cover.
Figure 21:
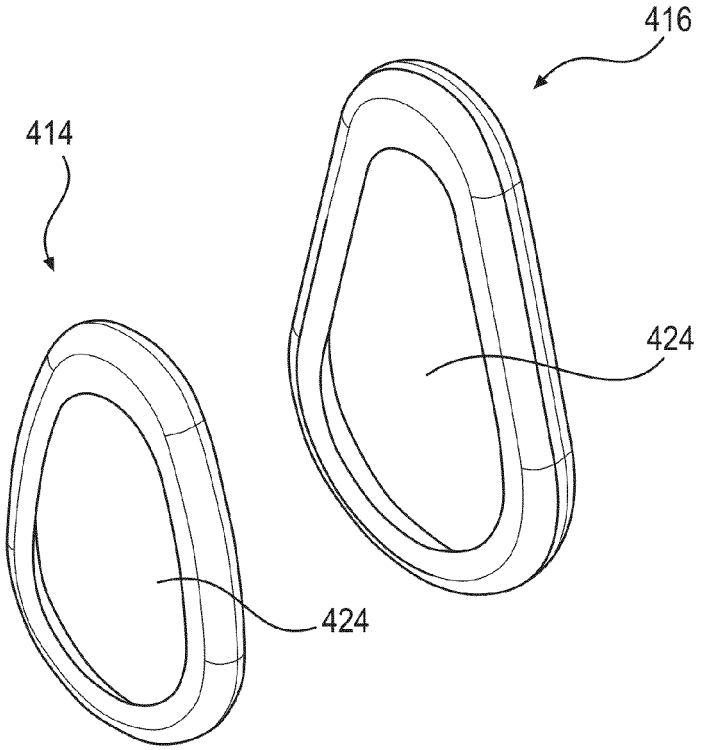
FIG. 21 is a perspective view of two sizes of fifth exemplary food covers, where the covers are in an unstretched state.

Referring to FIG. 20, fourth exemplary cover 314 is shown. Cover 314 is similar to cover 214 previously discussed except cover 314 has base second thin section 324*b* that may be flat. Base second section 324*b* has second thickness $t_2$ less than first thickness $t_1$ of base first section 324*a*. Base 324 lacks a third base section or live hinge like cover 214. Base second section 324*b* may be generally located at the center of base first section 324*a*.

If a user inserts food 230 (see FIG. 13), such as an avocado, into cover 314 (see FIG. 20), second wall section 318 compresses, as previously discussed above, to form second seal with food 230. Food 230 has exposed flat surface 232 and exposed curved surface 234. When food 230 contacts base 324, first seal will be formed between exposed fruit surfaces 232 and base section 324*a* and exposed pit surface 234 and base second section 324*b*. Base second section 324*b* has a thickness $t_2$ to allow section 324*b* to distend/stretch to accommodate pit P (see FIG. 13). When food 230 has pit P (see FIG. 13), base second section 324*b* stretches to be concave to mate with convex exposed curved surface 234. When food 236 (see FIG. 16) is inserted in cover 314, first seal may be formed, as previously discussed, and second seal may be formed between flat exposed surface 236*a* and base first section 324*a*. In an alternative example, cover 314 may be formed with thin center section 324*b* and have a different shape, such as circular, to work with food with pits of another shape.

Figure 22:
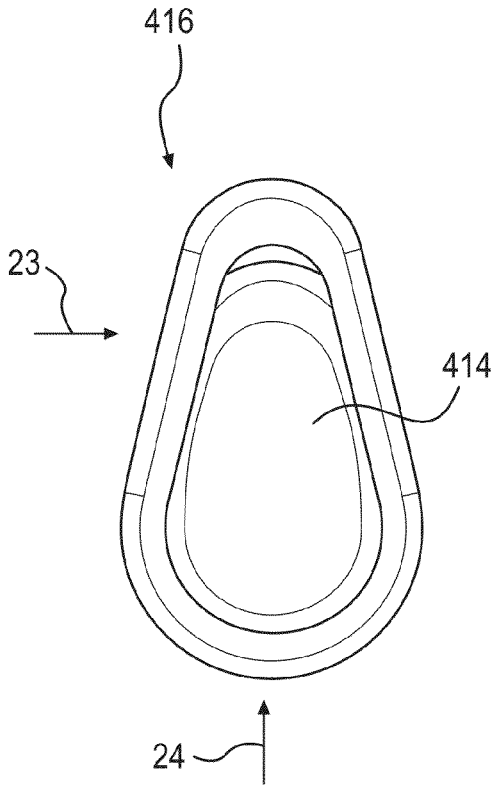
FIG. 22 is a front view of the food covers of FIG. 21 nested.
Figure 23:
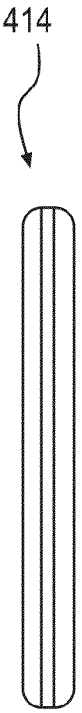
FIG. 23 is a side view of the food covers of FIG. 22 along arrow 23 of FIG. 22.
Figure 24:
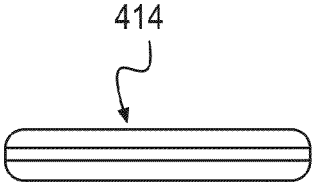
FIG. 24 is an end view of the food covers of FIG. 22 along arrow 24 of FIG. 22.

Referring to FIGS. 21-24, fifth exemplary covers 414 and 416 are shown. Covers 414 and 416 are similar to covers 214 and 216 previously discussed except covers 414, 416 have base 424 that may be flat. As a result, covers 414 and 416 function like cover 116 of FIG. 4. In FIG. 22, cover 414 may be nested within cover 416.

Figure 25:
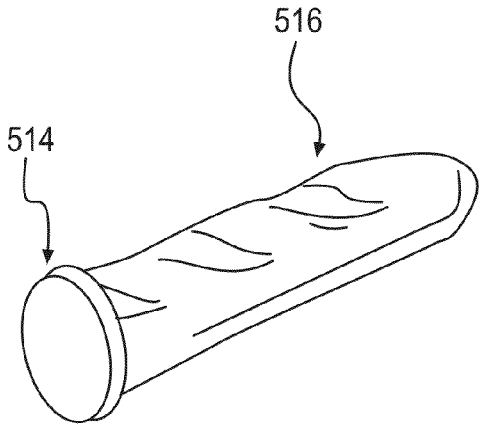
FIG. 25 is a perspective view of a sixth exemplary food cover for bread.
Figure 26:
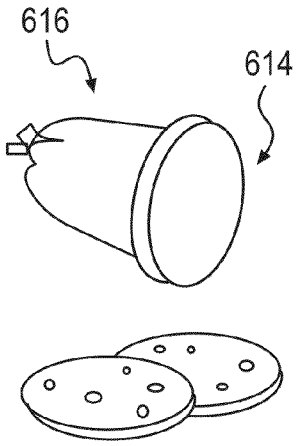
FIG. 26 is a perspective view of a seventh exemplary food cover for meat.
Figure 28:
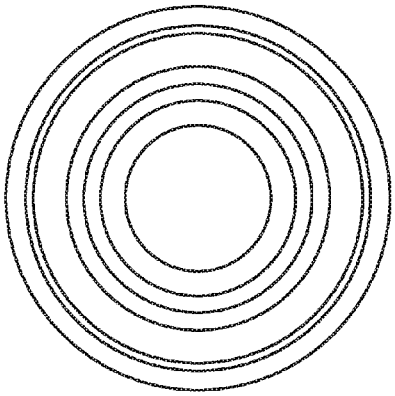
FIGS. 27-29 are perspective, top, and sectional views, respectively, of the covers of FIGS. 4-8 in a nested state.
Figure 27:
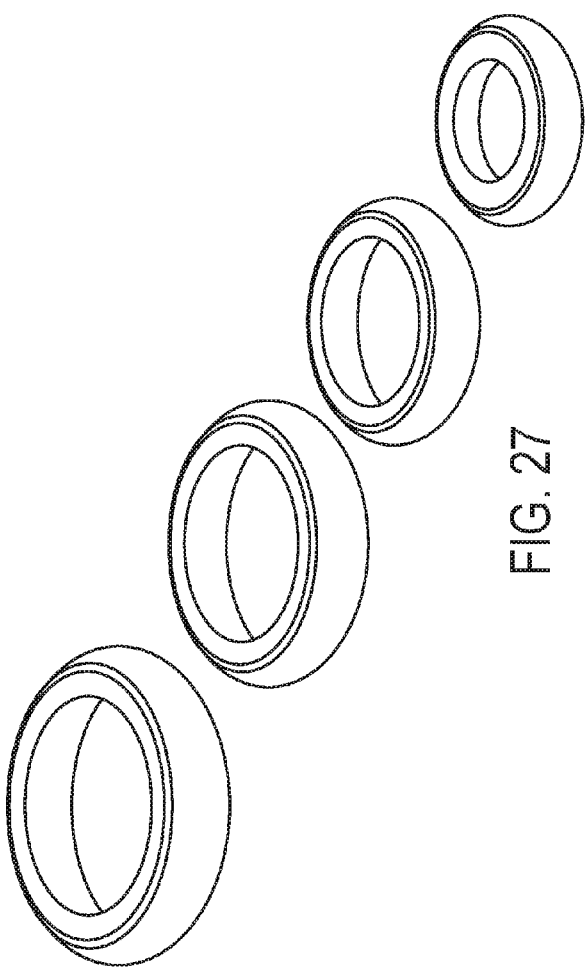
Figure 31:
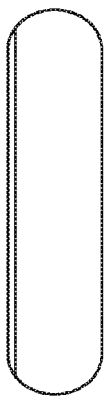
FIGS. 30-32 are bottom, first side, and second side views, respectively, of the extra-large cover of FIG. 27.
Figure 32:
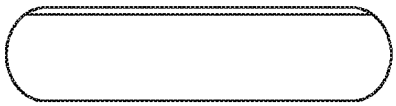
Figure 30:
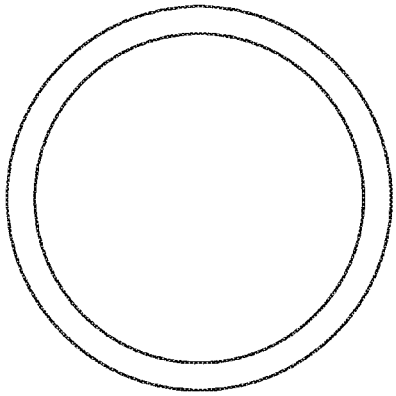
Figure 29:
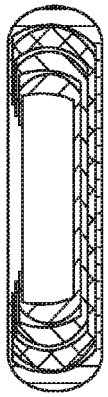
Figure 33:
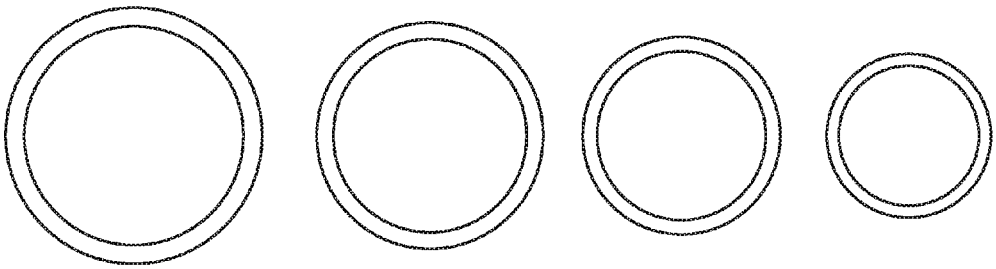
FIGS. 33-35 are top, bottom, and side views, respectively of the covers of FIG. 27.
Figure 34:
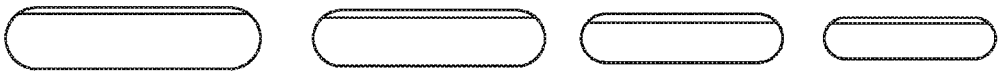
Figure 35:
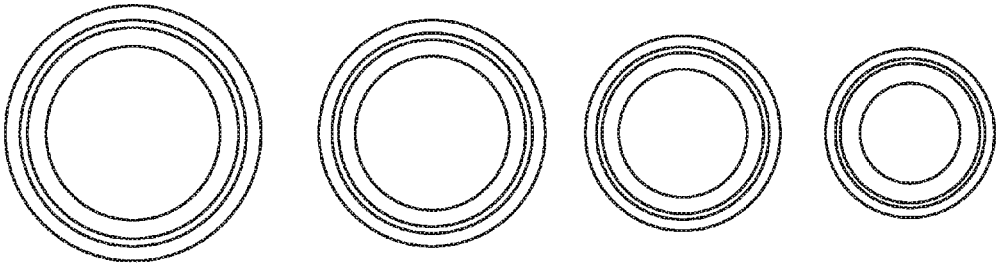
Figure 36:
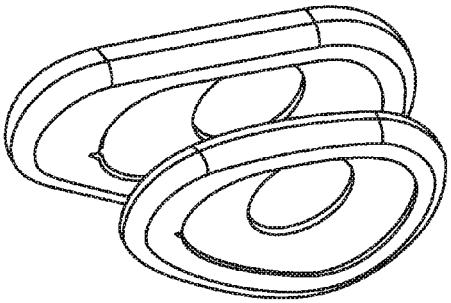
FIGS. 36-37 are perspective and top views, respectively, of the large and small covers of FIG. 11 where the covers are in a nested state.
Figure 39:
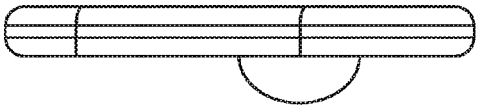
FIGS. 38-41 are end, side, top and bottom views, respectively, of the large cover of FIG. 36.
Figure 38:
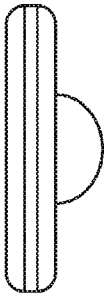
Figure 37:
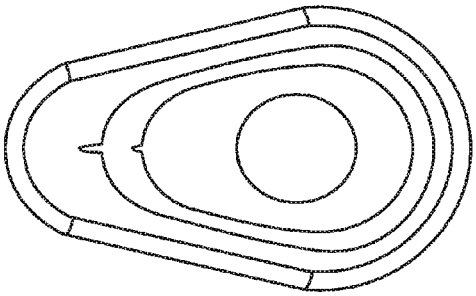
Figure 41:
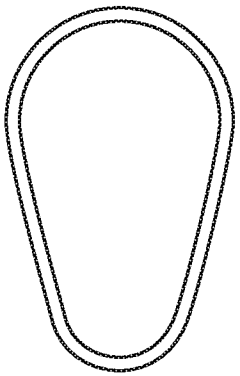
Figure 40:
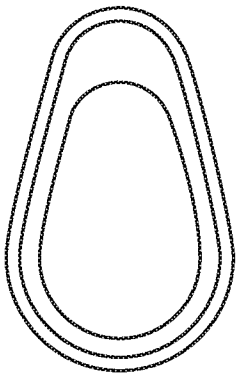
Figures 42, 43, 44, 45, 46:
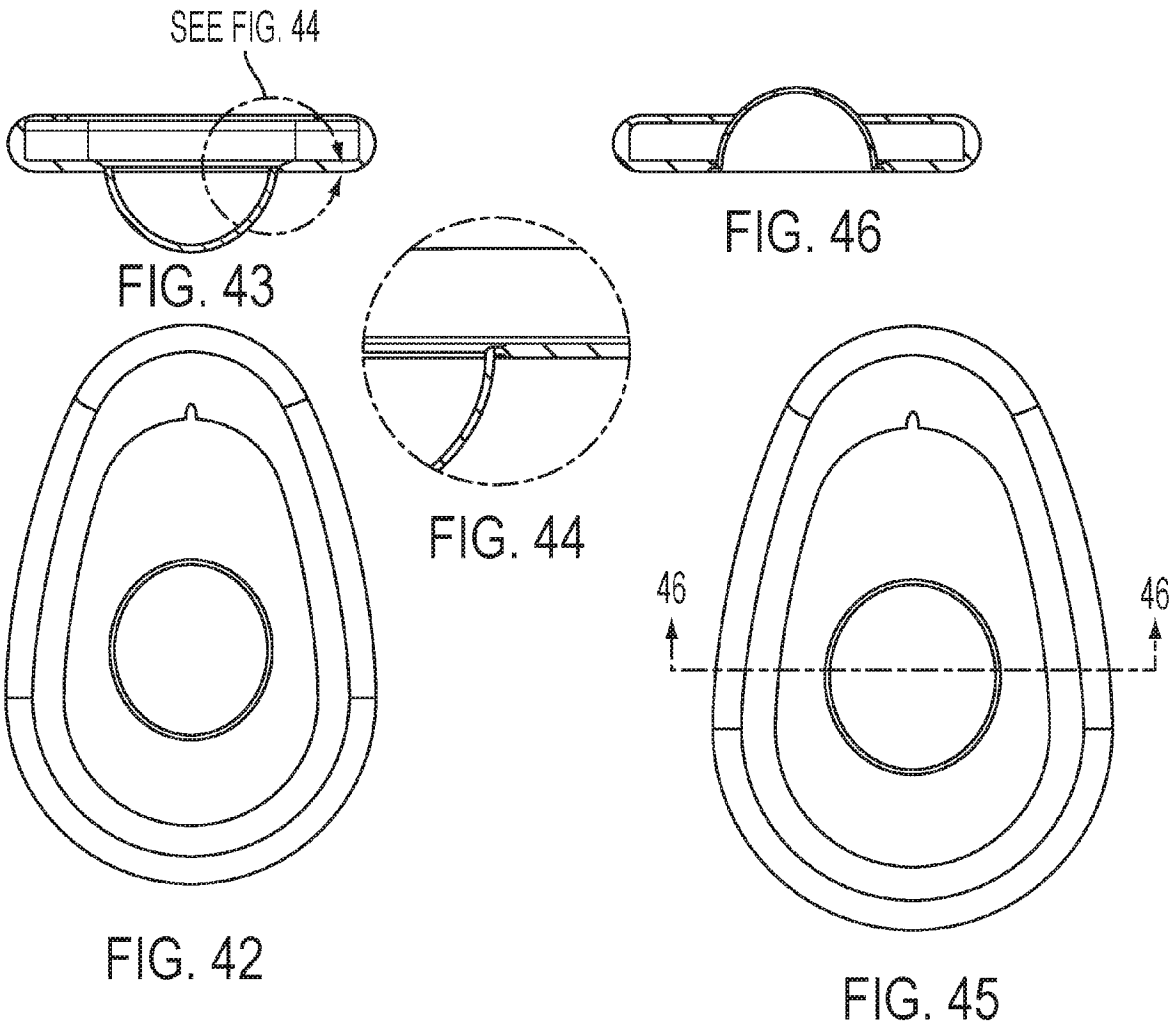
FIGS. 42-44 are top, cross-sectional, and enlarged views, respectively, of the small cover of FIG. 36, where the pit chamber is concave.
FIGS. 45-46 are top and cross-sectional views, respectively, of the small cover of FIG. 36, where the pit chamber is convex.
Figure 47:
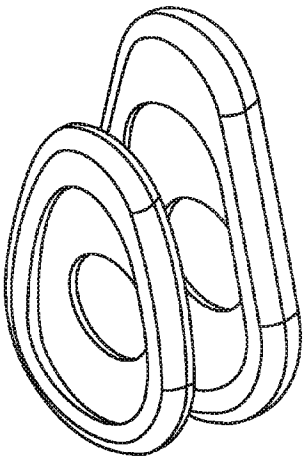
FIGS. 47-50 are perspective and top views, respectively, of the covers like covers of FIG. 36 without notch in top wall.
Figure 50:
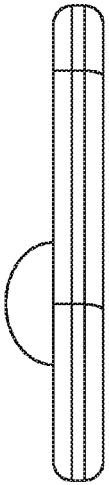
Figure 49:
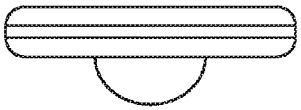
Figure 48:
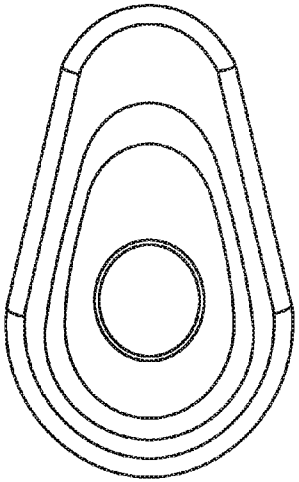
Figure 51:
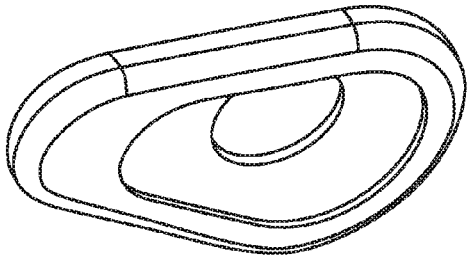
FIGS. 51-56 are first perspective, second perspective, top, end, side and bottom views, respectively, of the large cover of FIG. 47.
Figure 55:
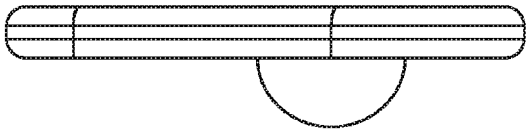
Figure 54:
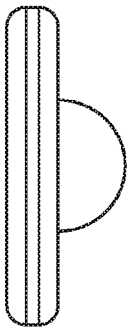
Figure 53:
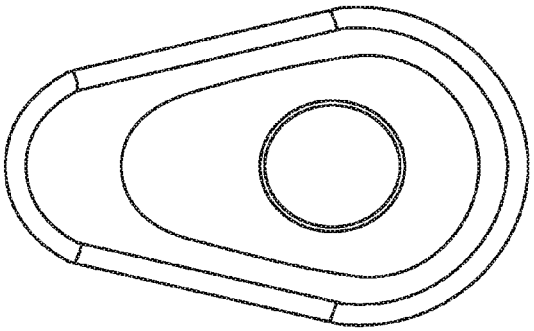
Figure 52:
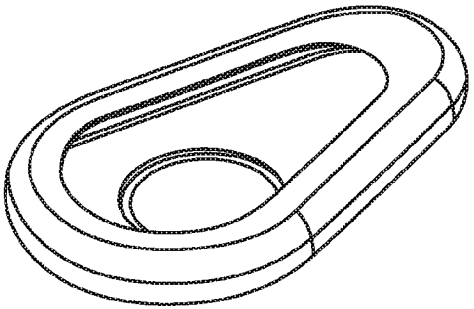

Referring to FIGS. 25-26, sixth and seventh exemplary covers 514 and 614 are shown. Covers 514 and 614 may be configured like covers 116 of FIG. 7, previously discussed except covers 514, 614 may be configured and dimensioned to accommodate foods such as bread 516 and meat 616, respectively.

Figure 56:
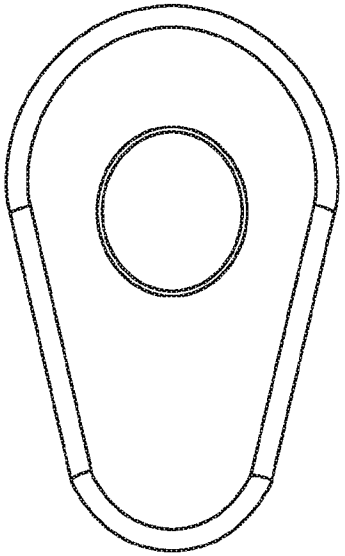
Figure 57:
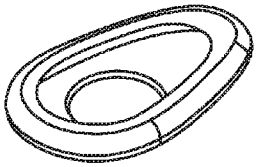
FIGS. 57-61 are perspective, top, bottom, end, and side views, respectively, of the small cover of FIG. 47.
Figure 61:
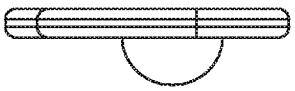
Figure 59:
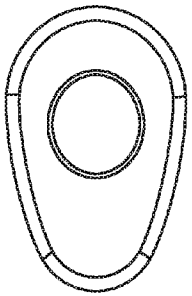
Figure 60:
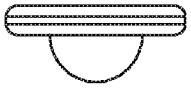
Figure 58:
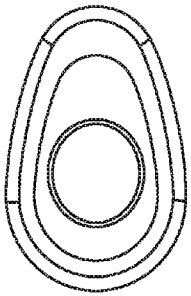
Figure 62:
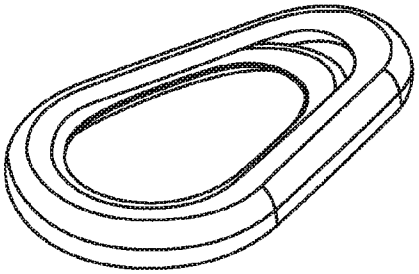
FIGS. 62-64 are first perspective, second perspective, and top views, respectively, of the covers of FIG. 21.
Figure 63:
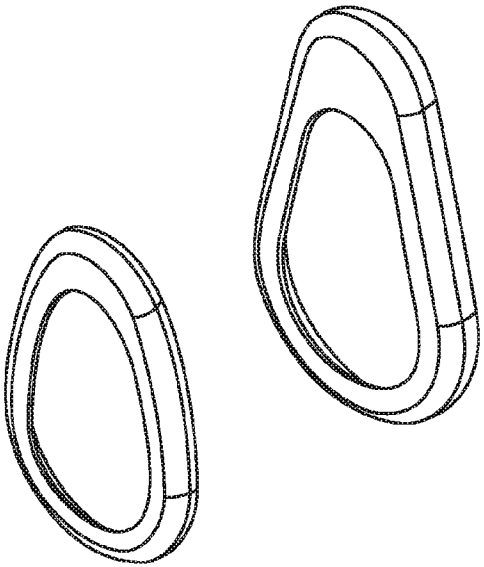
Figure 66:
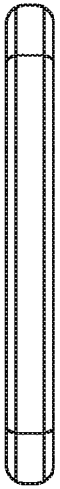
FIGS. 65-66 and 67-68 are end, side, bottom and top views, respectively, of the large cover of FIG. 63.
Figure 65:
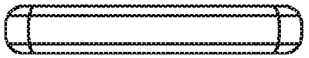
Figure 64:
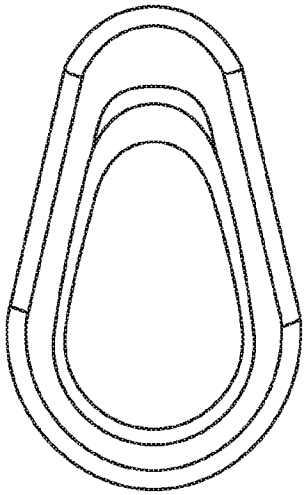
Figure 68:
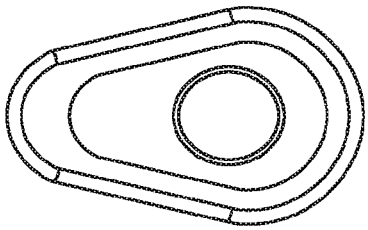
Figure 67:
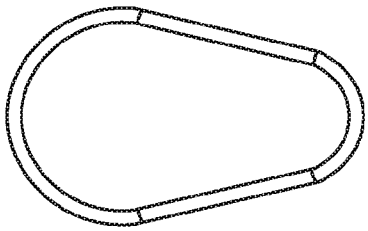
Figure 70:
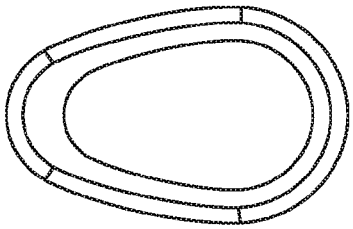
FIGS. 69-72 are bottom, top, end and side views, respectively, of the small cover of FIG. 63.

Those skilled in the art will appreciate that the conception, upon which this disclosure is based, may readily be utilized as a basis for designing other products. Therefore, the claims are not to be limited to the specific examples depicted herein. For example, the features of one example disclosed above can be used with the features of another example. Covers 12, 14, 16, 110, 112, 114, 116, 214, 216, 314, 414, 416, 514, 614, and covers shown in FIGS. 27-72 may be formed of by the same method and materials as discussed with respect to cover 10. For example, decoration and/or text can be used on any examples. This decoration such as images and/or text can be formed on the covers during molding. Exemplary decoration is shown in, for example FIG. 56. Moreover, providing the covers in different colors in a set or the same color may be used in any of the examples. Sets of covers may be of the same size and shape, so they cannot nest or can be of different shapes and sizes so that they may be nestable. Covers of each exemplary configuration may be formed in a variety of sizes and depths, so that they can be used with a variety of foods or to act as a reusable cover on dishes and food storage vessels. Alternate versions of this invention might support food preservation applications that are not described above. Alternate versions of the covers may be scaled to cover other food items. Thus, the details of these components as set forth in the above-described examples, should not limit the scope of the claims.

Figure 72:
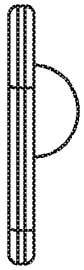
Figure 69:
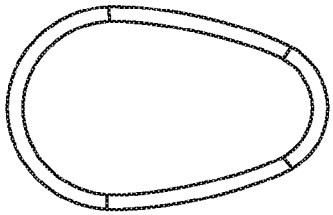
Figure 71:
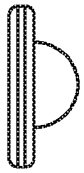

The inventors hereby describe and possess the overall appearance shown in FIGS. 1-72 and any and all parts and/or portions thereof. FIGS. 27-72 may include color, text/logos, images, CAD lines, lead lines, dimension lines and jagged/pixilated edge lines that may not be part of the design. In FIGS. 40, 67, and 69-70, the white color of the base or bottom is not part of the claimed design and is clearly illustrated in the corresponding perspective views. The inventors and/or the Applicant reserve the right to create line drawings from any of the FIGS. 1-72.

Further, the purpose of the Abstract is to enable the U. S. Patent and Trademark Office, and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the claims of the application nor is intended to be limiting on the claims in any way.

What is claimed is:

1. A cover for covering food comprising:

a base;

a flexible wall extending upwardly from and surrounding said base to define a chamber with an opening, said flexible wall having an initial state where the opening is a first size and having a final state where the opening is a second size different from said first size;

wherein the flexible wall includes a first section that extends upwardly from the base, the first section having a bottom portion attached to the base, and a top edge spaced from the bottom portion;

the flexible wall also comprising a second section that extends radially inwardly from the top edge of the first section;

wherein the first section has a first thickness and the second section has a second thickness, and wherein the first thickness is greater than the second thickness;

whereby upon inserting food within said chamber, said flexible wall moves from said initial state to said final state and a first seal is created between the food and the cover;

wherein said base further includes a first section having a first thickness and a second section having a second thickness less than said first thickness, said second section being located at approximately a center of said first section; and wherein said base further includes a third section, wherein the third section comprises a hinge portion, and wherein the hinge portion is configured to allow the second section to transition between a convex state and a concave state.

2. The cover of claim 1, wherein said base and said flexible wall are formed of a single, unitary material.

3. The cover of claim 2, wherein said material is silicone.

4. The cover of claim 1, whereby upon inserting food within said chamber, an exposed surface of the food contacts at least a portion of the base to form a second seal between the food and the cover.

5. The cover of claim 1, wherein said base has a generally circular shape.

6. The cover of claim 1, wherein the second section of the flexible wall is configured to form the first seal with the food.

7. The cover of claim 1, wherein the second section of the flexible wall includes a slit.

8. The cover of claim 7, wherein the second section of the flexible wall is configured to bend inwardly when food is inserted into the cover.

9. A cover for covering food comprising:

a base;

a flexible wall extending upwardly from and surrounding said base to define a chamber with an opening, said flexible wall having an initial state where the opening is a first size and having a final state where the opening is a second size different from said first size;

whereby upon inserting food within said chamber, said flexible wall moves from said initial state to said final state and a first seal is created between the food and the cover; and wherein said base includes a first section having a first thickness, a second section having a second thickness less than said first thickness, a third section having a third thickness less than said second thickness, said second section being shaped like a hemisphere, and said third thickness allows said second section to have a concave state or a convex state, said second section being located at approximately a center of said first section.

10. A set of covers for covering food comprising, a first cover and a second cover;

the first cover including a first base and a first flexible wall, the first flexible wall comprising a first section and a second section, the first section extending upwardly and surrounding the first base to define a first chamber with an opening, wherein the second section of the first flexible wall extends from a top edge of the first section to define a first chamber height, the first chamber height being a distance from the second section to the first base;

the second cover including a second base and a second flexible wall, the second flexible wall having a second height;

wherein the second height of the second flexible wall is less than the first chamber height so that the second cover can be placed within the first chamber of the first cover;

wherein a first section of the first base has a first thickness, wherein a second section of the first base has a second thickness, and wherein the second thickness is less than the first thickness; and wherein the first base further includes a third section, wherein the third section comprises a hinge portion, and wherein the hinge portion is configured to allow the second section of the first base to transition between a convex state and a concave state.

11. The set of claim 10, wherein the first base has a first diameter and the second base has a second diameter, wherein the first diameter is greater than the second diameter, and wherein the first cover is configured to retain the second cover.

12. The set of claim 11, wherein said first and second covers are different colors.

13. The set of claim 11, further including a third cover, wherein said third and second covers are sized so that said third cover nests within said second cover.

14. The set of claim 13, further including a fourth cover, wherein said fourth and third covers are sized so that said fourth cover nests within said third cover.

15. The set of claim 12, wherein the second section of the first flexible wall is configured to secure the second cover within the first chamber when the second cover is disposed within the first cover.

16. The set of claim 10, wherein the third section of the first base has a third thickness that is less than the second thickness.

17. The cover of claim 1, wherein the third section of the base is disposed between the first section of the base and the second section of the base.

18. The cover of claim 9, wherein the second size is greater than the first size.

19. The cover of claim 9, wherein the first section comprises a substantially flat surface.

20. The cover of claim 9, wherein the food includes an exposed flat surface that forms a second seal with at least a portion of the base when the food is inserted into the chamber.

21. The cover of claim 20, wherein the food further includes an exposed curved surface that forms a third seal with at least a portion of the base when the food is inserted into the chamber.

22. The cover of claim 9, wherein the flexible wall further includes a second wall section that is configured to deform when food is inserted into the chamber in order to form the first seal with the food.

23. The cover of claim 21, wherein the second thickness of the second section of the base allows the second section to stretch to accommodate the exposed curved surface of the food.

24. The cover of claim 22, wherein the second wall section of the flexible wall includes a slit configured to facilitate the deformation of the second wall section when food is inserted into the chamber.

25. The cover of claim 1, wherein the third section of the base has a third thickness that is less than the second thickness.

26. The cover of claim 1, wherein the second section of the base has a substantially hemispherical shape.

27. The cover of claim 1, wherein the first section of the base comprises a substantially flat surface.

* * * * *